United States Patent [19]

Osborne

[11] 4,207,646

[45] Jun. 17, 1980

[54] CHALKBOARD ERASERS

[76] Inventor: Robert D. Osborne, Box 377, Rural Retreat, Va. 24368

[21] Appl. No.: 38,221

[22] Filed: May 11, 1979

[51] Int. Cl.[2] ..... B43L 21/00

[52] U.S. Cl. ..... 15/224; 15/210 R

[58] Field of Search ..... 15/210, 208, 209 R, 15/210 A, 210 B, 118, 223, 224, 225, 221, 114

[56] References Cited

U.S. PATENT DOCUMENTS

| | | | |
|---|---|---|---|
| 754,900 | 3/1904 | Seith | 15/114 X |
| 1,487,052 | 3/1924 | Enomoto | 15/210 R |
| 3,317,944 | 5/1967 | Napier | 15/223 X |
| 3,986,224 | 10/1976 | Yang | 15/224 |

*Primary Examiner*—Edward J. McCarthy

[57] ABSTRACT

A chalkboard eraser including an elongated rigid tubular core member and a resilient body member fixed to the core member and disposed about the core member and generally coextensive therewith, the body member having alternate lands and grooves extending lengthwise and disposed about its periphery.

6 Claims, 4 Drawing Figures

CHALKBOARD ERASERS

BACKGROUND OF THE INVENTION

1. Field of the Invention

This invention relates to chalkboard devices and is directed more particularly to a chalkboard eraser suitable for use as a "dry" eraser or as a "wet" eraser.

2. Description of the Prior Art

Commonly used chalkboard erasers, comprising laminated felt pads, are prone to the collection of chalkdust on the surface thereof, causing the efficiency of the erasers to drop markedly in short order, and requiring frequent cleaning of the erasers. Such erasers are as a practical matter limited to use as dry erasers.

SUMMARY OF THE INVENTION

An object of the present invention is to provide an eraser in which a first portion of the working surface is used for erasing and a second portion is used for storage of chalkdust.

Another object of the invention is to provide an eraser which is suitable for use as a dry eraser or as a wet eraser.

Still another object of the invention is to provide such an eraser for use in conjunction with a sleeve member adapted to be disposed upon and substantially cover the above referred to working surface when the eraser is used as a dry eraser.

A further object of the invention is to provide the combination of the eraser, as referred to above, and a cleaner member for removing chalkdust therefrom when the eraser is used as a dry eraser.

A still further object of the invention is to provide the combination of the eraser, as referred to above, and a holder adapted to retain liquid and retain said eraser in such a manner as to facilitate wetting of the surface of said eraser and use of the eraser as a wet eraser.

Another object is to provide such an eraser and combinations as are relatively inexpensive to manufacture and convenient and efficient to use.

With the above and other objects in view, as will hereinafter appear, a feature of the present invention is the provision of a chalkboard eraser comprising an elongated rigid tubular core member, and a resilient body member fixed to the core member and disposed about the core member, the body member being generally coextensive with the core member, the body member having alternate lands and grooves extending lengthwise and disposed about its periphery.

In accordance with a further feature of the invention, there is provided a flexible sleeve member adapted to be disposed upon and generally enclose the body member.

In accordance with another feature of the invention, there is provided a cleaner member having a comb portion shaped complementarily to the periphery of the body portion and adapted to be moved lengthwise of the body member.

In accordance with a still further feature of the invention, there is provided a holder comprising a tray having one or both ends shaped complementarily to the periphery of the body member, the tray being adapted to retain a liquid-impregnated sponge member to effect wetting of the peripheral surface of the body member.

The above and other features of the invention, including various novel details of construction and combinations of parts, will now be more particularly described with reference to the accompanying drawings and pointed out in the claims. It will be understood that the particular devices embodying the invention are shown by way of illustration only and not as limitations of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention from which its novel features and advantages will be apparent.

In the drawings.

DESCRIPTION OF THE PREFERRED EMBODIMENTS

Figure 1:
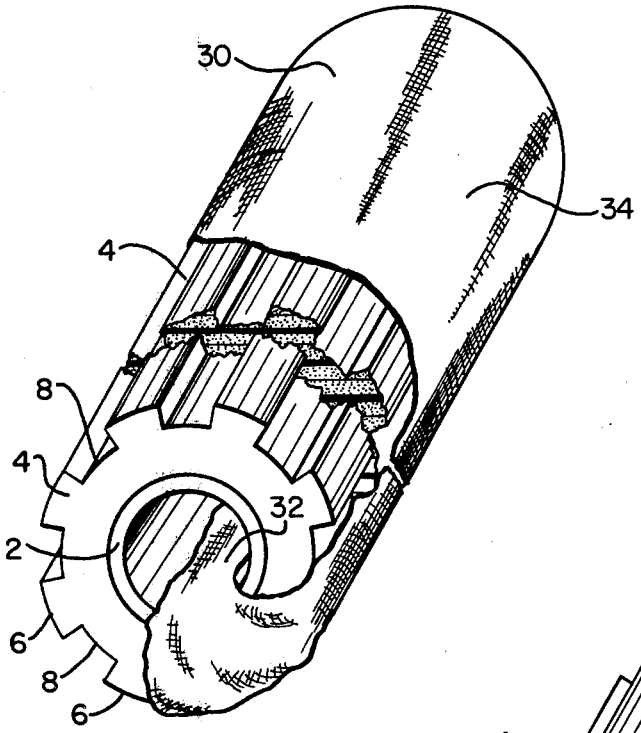
FIG. 1 is a perspective view of one form of a chalkboard eraser illustrative of an embodiment of the invention, and further showing, in part, a sleeve member illustrative of a second embodiment of the invention.
Figure 4:
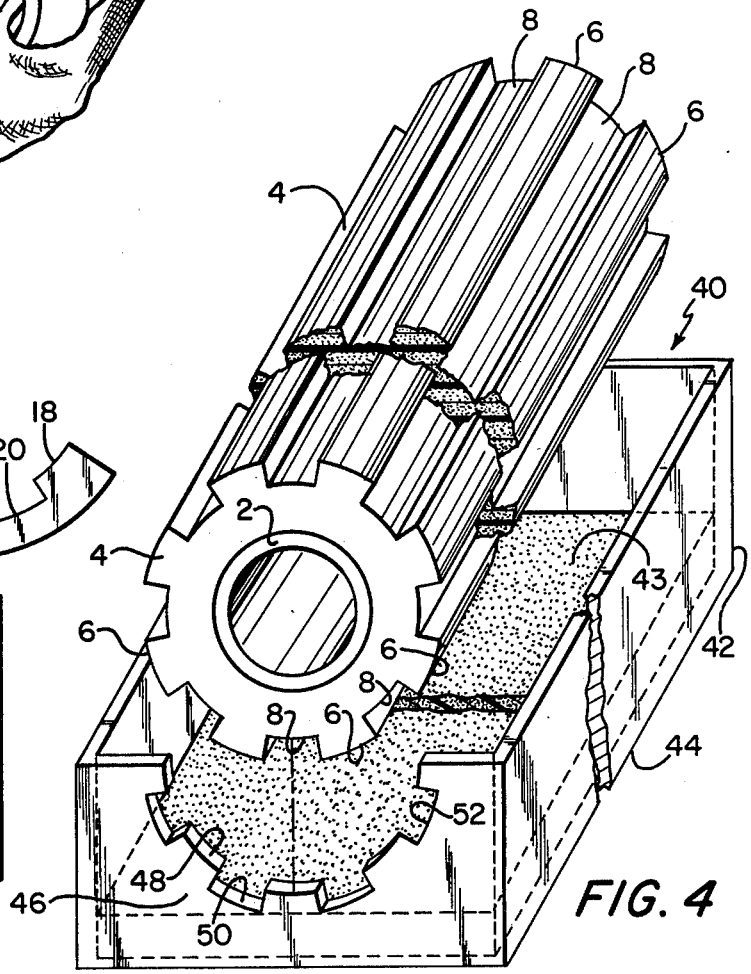
FIG. 4 is a perspective view of a holder for use with and shown in conjunction with the eraser of FIG. 1.

Referring to FIGS. 1 and 4, it will be seen that the illustrative eraser includes a rigid core member 2, preferably of a rigid plastic, and comprising an elongated tubular member. A generally cylindrically-shaped body member 4, of a resilient sponge-like material, is fixed to the core member 2 and is concentric thereto and is generally coextensive therewith. The body member 4 is provided with alternate lands and grooves 6, 8 extending lengthwise thereof and disposed about is periphery. The outer surfaces of the lands 6 constitute working surfaces and the grooves 8 provide reservoirs for the collection of chalkdust.

Figure 3:
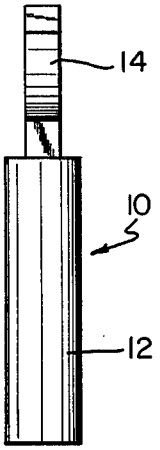
FIG. 3 is a side elevational view of the cleaner member of FIG. 2.
Figure 2:
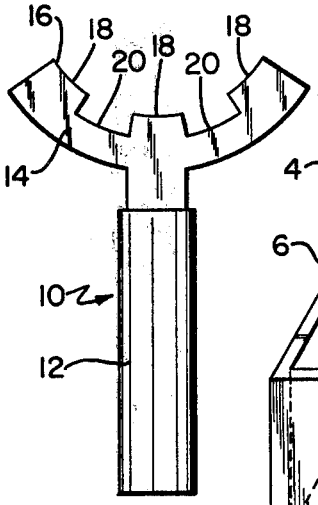
FIG. 2 is a front elevational view of a cleaner member for use in conjunction with an eraser as shown in FIG. 1.

Referring to FIGS. 2 and 3, it will be seen that a cleaner member 10 is provided and includes a handgrip portion 12 and a comb portion 14 mounted on one end of the handgrip portion 12 and extending transversely thereto. The comb portion 14 has an exposed surface 16 shaped complementarily to a portion of the periphery of the body member 4, i.e., having lands and grooves 18, 20 interfitting with a portion of the lands and grooves 6, 8 of the body member 4.

In use, the cleaner member 10 is brought into complementary engagement with the body member 4, and the comb portion 14 moved lengthwise of the body member 4, to scrape the land and groove surfaces of the body member clean.

Referring again to FIG. 1, it will be seen that there may be provided a sleeve 30 for use in conjunction with the eraser as above described. The sleeve 30 is of a flexible material, such as terrycloth, and is adapted to be disposed upon and generally enclose the body member 4. Free ends 32 of the sleeve 30 may be tucked into the interior of the rigid member 2, to secure the sleeve 30 on the body member 4.

In use with the sleeve, the entire outer surface 34 of the eraser becomes a working surface. Preferably, the material of the sleeve is sufficiently porous to allow the chalkdust to pass therethrough to the grooves 8, to be retained there until cleaning. To clean the eraser, the free ends 32 of the sleeve 30 are removed from the rigid member 2 and dust collected in the sleeve is emptied therefrom. For a more thorough cleaning, the sleeve is removed, and the eraser subjected to the cleaning operation above described.

In FIG. 4 there is shown a holder which facilitates use of the eraser as a wet eraser, rather than as a dry eraser. The holder 40 comprises a tray 42 adapted to retain a liquid-impregnated sponge 43 in a bottom portion 44 thereof. The tray 42 is provided with at least one upstanding end portion 46 having an exposed edge 48 shaped complementarily to the lands and grooves 6, 8 of the body member 4, i.e., having lands and grooves 50, 52 interfitting with a portion of the lands and grooves of the body member. The liquid-retaining sponge member 43 in the bottom portion 44 of the tray 42 conveys the liquid therein, such as water, to the body member 4 when the eraser is rested on the sponge in the holder.

When it is desired to use the eraser, the eraser is slid along the exposed edge of one of the shaped ends 46 to clean the surface of the eraser and lifted for use. After use, the eraser is again deposited on the holder.

Thus, there is provided a chalkboard eraser which may be used as a dry wet eraser, and there is further provided means for enhancing use of the eraser in either mode.

It is to be understood that the present invention is by no means limited to the particular construction herein disclosed and/or shown in the drawings, but also comprises any modifications or equivalents within the scope of the disclosure.

Having thus described my invention what I claim as new and desire to secure by Letters Patent of the United States is:

1. A chalkboard eraser comprising an elongated rigid tubular core member, and a resilient body member fixed to said core member and disposed about said core member and generally coextensive therewith, said body member having alternate lands and grooves extending lengthwise and disposed about its periphery.

2. The invention in accordance with claim 1 in which said body member is a generally cylindrically-shaped member, said core member and said body member being concentrically disposed.

3. The invention in accordance with claim 2 and including a flexible sleeve member adapted to be disposed upon and generally enclose said body member.

4. The invention in accordance with claim 3 in which said core member is adapted to receive free ends of said sleeve member.

5. A chalkboard eraser assembly comprising the invention according to claim 2 and a cleaner member comprising a handgrip portion, and a comb portion mounted on one end of said handgrip portion and extending transversely thereto, said comb portion having an exposed surface shaped complementarily to said lands and grooves of a portion of said body member, said comb portion being adapted to engage the periphery of said portion of said body member and to be moved lengthwise of said body member.

6. A chalkboard eraser assembly comprising the invention according to claim 2, and a holder comprising a tray, said tray being adapted to receive and retain a sponge member in a bottom portion thereof, an upstanding end portion of said tray having an exposed edge shaped complementarily to said lands and grooves of a portion of said body member, said edge being adapted to complementarily engage the periphery of said eraser.

* * * * *